US008276236B2

(12) United States Patent
Goodman et al.

(10) Patent No.: US 8,276,236 B2
(45) Date of Patent: Oct. 2, 2012

(54) BASEBOARD CLEANING APPARATUS

(76) Inventors: Michele I. Goodman, Litchfield Park, AZ (US); Isaias Luna, Avondale, AZ (US)

( * ) Notice: Subject to any disclaimer, the term of this patent is extended or adjusted under 35 U.S.C. 154(b) by 472 days.

(21) Appl. No.: 12/701,069

(22) Filed: Feb. 5, 2010

(65) Prior Publication Data

US 2011/0191972 A1 Aug. 11, 2011

(51) Int. Cl.
*A47L 13/10* (2006.01)
*A47L 13/16* (2006.01)
*A47L 13/00* (2006.01)

(52) U.S. Cl. ..... 15/210.1; 15/144.1; 15/144.2; 15/160; 15/228; 15/244.1; 15/244.2; 15/172

(58) Field of Classification Search ..... 15/144.1, 15/144.2, 160, 210.1, 228, 244.1, 244.2, 15/172, 49.1; *A47L 13/00*
See application file for complete search history.

(56) References Cited

U.S. PATENT DOCUMENTS 3,713,744 A 1/1973 Sims
7,296,943 B2 11/2007 Sandoval

*Primary Examiner* — Robyn Doan
*Assistant Examiner* — Tatiana Nobrega
(74) *Attorney, Agent, or Firm* — Parsons & Goltry; Michael W. Goltry; Robert A. Parsons

(57) ABSTRACT

A baseboard cleaning apparatus for cleaning a baseboard of a wall extending upright along the wall with respect to a floor includes a cleaning head and a block positioned in either side of a skid plate, and which are connected by a connector that extends through a slot formed in the skid plate. The skid plate has a lower extremity formed with a skid, and the connector is movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

11 Claims, 8 Drawing Sheets

A
20
26
28
31
30
80
64
62
65
60
61
47
40
41
42
110
112
102
100
104
101
97
71
70
92
155
113
24
120
90
145
140
148
153
162
152
153
150
142
189
111
105
131
123
122
121
141
114
115
130
91
22
188
180
72
98
57
50
48
23
27
55
51

BASEBOARD CLEANING APPARATUS

FIELD OF THE INVENTION

The present invention relates to apparatus and methods for cleaning a baseboard of a wall.

BACKGROUND OF THE INVENTION

A baseboard is a board that forms the foot of an interior wall formed at the floor, and which extends upright with respect to the floor and has front and top faces that routinely become dirty and thus require periodic cleaning. Cleaning a baseboard is often done by hand or with a broom. Cleaning a baseboard with a broom may scratch the baseboard, and cleaning a baseboard by hand is time-consuming and difficult requiring bending, stooping, and kneeling for long periods, which can be uncomfortable and which can result in personal injury in the form of a pulled back, bruised knees, or the like. In an effort to assist users in cleaning baseboards, skilled artisans have devoted considerable time an effort in the development of specialized baseboard cleaning devices designed to be used while standing thereby alleviating the need to bend, stoop, or kneel. Although such devices have proven adequate, they are difficult to construct, cumbersome, and are not able to accommodate baseboards of varying sizes. As such, continued improvement in the field of specialized baseboard cleaning devices is evident.

SUMMARY OF THE INVENTION

According to the principle of the invention, a baseboard cleaning apparatus for cleaning front and top faces of a baseboard of a wall and that extends upright along the wall with respect to a floor includes a skid plate having opposed inner and outer faces, opposed first and second sides, opposed upper and lower extremities extending between the opposed first and second sides, and a skid formed in the lower extremity of the skid plate extending from the first side of the skid plate to the second side of the skid plate and which is configured to slide along the floor adjacent to the baseboard. A slot, having opposed upper and lower ends, is formed through the skid plate between the opposed first and second sides of the skid plate and which extends from the lower end directed toward the lower extremity of the skid plate to the upper end directed toward the upper extremity of the skid plate. A baseboard cleaning head is positioned along the inner face of the skid plate between the upper extremity of the skid plate and the skid formed in the lower extremity of the skid plate. The baseboard cleaning head has first and second cleaning faces configured to simultaneously contact the front and top faces of the baseboard. A fixture is positioned along the outer face of the skid plate between the upper extremity of the skid plate and the skid formed in the lower extremity of the skid plate. A connector extends through the slot connecting the cleaning head to the fixture capturing the skid plate between the cleaning head and the fixture. The connector is movable along the slot between lowered positions of the baseboard cleaning head and the fixture away from the upper extremity of the skid plate toward the skid formed in the lower extremity of the skid plate, and raised positions of the baseboard cleaning head and the fixture away from the skid formed in the lower extremity of the skid plate toward the upper extremity of the skid plate. A washer encircles the connector and is positioned between the baseboard cleaning head and the inner face of the skid plate. A handle is mounted to the fixture. Preferably, the handle is further mounted to the fixture for pivotal movement.

The skid is an elongate, flat runner having a first upturned portion formed proximate to the first side of the skid plate, and an opposed second upturned portion formed proximate to the second side of the skid plate.

According to the principle of the invention, a baseboard cleaning apparatus for cleaning front and top faces of a baseboard of a wall and that extends upright along the wall with respect to a floor includes a skid plate having opposed inner and outer faces, opposed first and second sides, opposed upper and lower extremities extending between the opposed first and second sides, and a skid formed in the lower extremity of the skid plate extending from the first side of the skid plate to the second side of the skid plate and which is configured to slide along the floor adjacent to the baseboard. A slot, having opposed upper and lower ends, is formed through the skid plate between the opposed first and second sides of the skid plate and which extends from the lower end directed toward the lower extremity of the skid plate to the upper end directed toward the upper extremity of the skid plate. A baseboard cleaning head is positioned along the inner face of the skid plate between the upper extremity of the skid plate and the skid formed in the lower extremity of the skid plate. The baseboard cleaning head is formed with a cleaning pad having first and second cleaning faces configured to simultaneously contact the front and top faces of the baseboard. An engagement assembly is formed between the cleaning pad and the baseboard cleaning head releasably securing the cleaning pad to the baseboard cleaning head. A fixture is positioned along the outer face of the skid plate between the upper extremity of the skid plate and the skid formed in the lower extremity of the skid plate. A connector extending through the slot and connects the cleaning head to the fixture capturing the skid plate between the cleaning head and the fixture. The connector is movable along the slot between lowered positions of the baseboard cleaning head and the fixture away from the upper extremity of the skid plate toward the skid formed in the lower extremity of the skid plate, and raised positions of the baseboard cleaning head and the fixture away from the skid formed in the lower extremity of the skid plate toward the upper extremity of the skid plate. The engagement assembly is a hook and loop fastener having an element thereof carried by the cleaning pad and a complementing element thereof carried by the baseboard cleaning head. A handle is mounted to the fixture. Preferably, the handle is further mounted to the fixture for pivotal movement. A washer encircles the connector and is positioned between the baseboard cleaning head and the inner face of the skid plate. The skid is an elongate, flat runner having a first upturned portion formed proximate to the first side of the skid plate, and an opposed second upturned portion formed proximate to the second side of the skid plate.

BRIEF DESCRIPTION OF THE DRAWINGS

Referring to the drawings.

DETAILED DESCRIPTION

Figure 1:
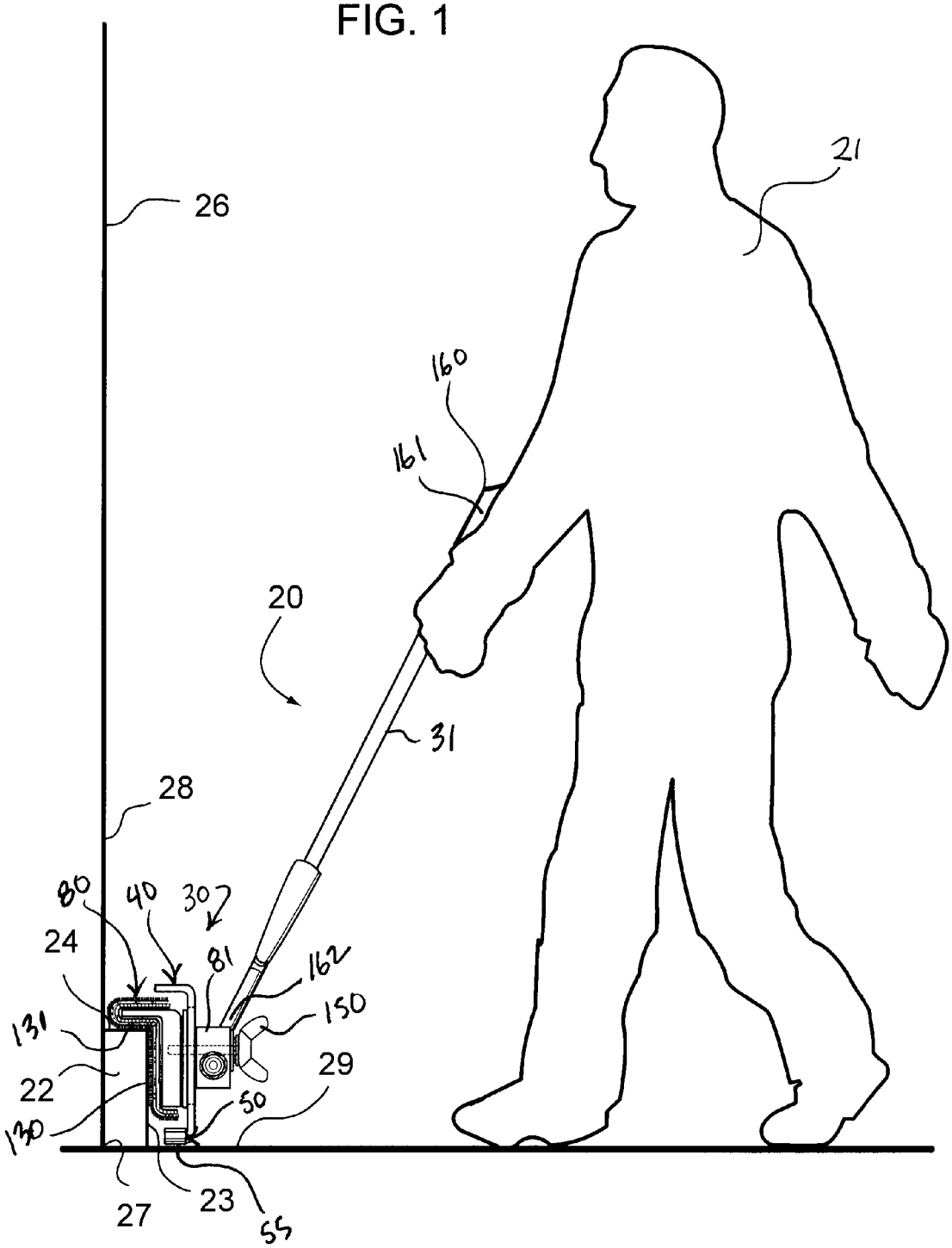
FIG. 1 is a side elevation view of a baseboard cleaning apparatus constructed and arranged in accordance with the principle of the invention shown as it would appear in use cleaning a baseboard, the baseboard cleaning apparatus including a handle attached to a cleaning head assembly.

Turning now to the drawings, in which like reference characters indicate corresponding elements throughout the several views, attention is directed to FIG. 1 illustrating a side elevation view of a baseboard cleaning apparatus 20 constructed and arranged in accordance with the principle of the invention shown as it would appear in use by a user 21 cleaning a baseboard 21 having adjoining front and top faces 23 and 24. Baseboard 21, which those of ordinary skill in the art also refer to as a skirting board, a skirting, a floor molding, or a base molding, is an elongate board or plank generally made of wood, plastic, or other like or similar material that is applied to cover the lowest part of an interior wall 25 to cover joint 27 at the intersection of wall surface 228 and floor 29. Baseboard 22 is applied to wall surface 28, and is conventionally nailed, screwed, or adhered to wall 25 with an adhesive. Baseboard 22 and wall 25 extend upright with respect to floor 29, which is substantially horizontal with respect to baseboard 22 and wall 25. Baseboard 22 forms part of wall 25, and extends upright along wall surface 28 with respect to floor 29. Apparatus 20 consists of a cleaning head assembly generally denoted at 30, and an attached handle 31, which, as shown in FIG. 1, may be taken up by hand by user 21 in a standing position to wield apparatus 20 and apply cleaning head assembly 30 to baseboard 22 for cleaning purposes.

Figure 3:
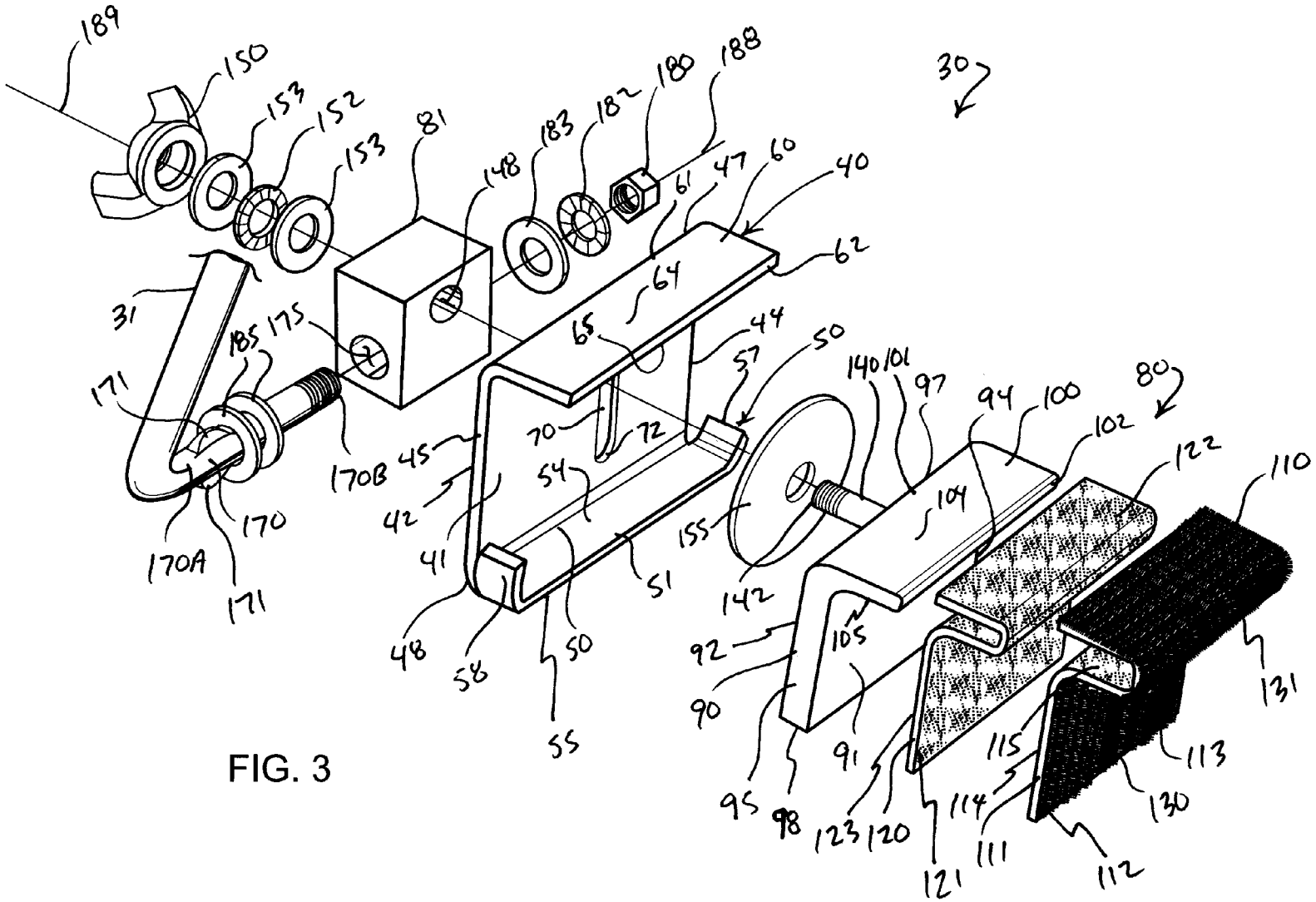
FIG. 3 is an exploded perspective view of the cleaning head assembly of the baseboard cleaning apparatus of FIG. 1.
Figure 4:
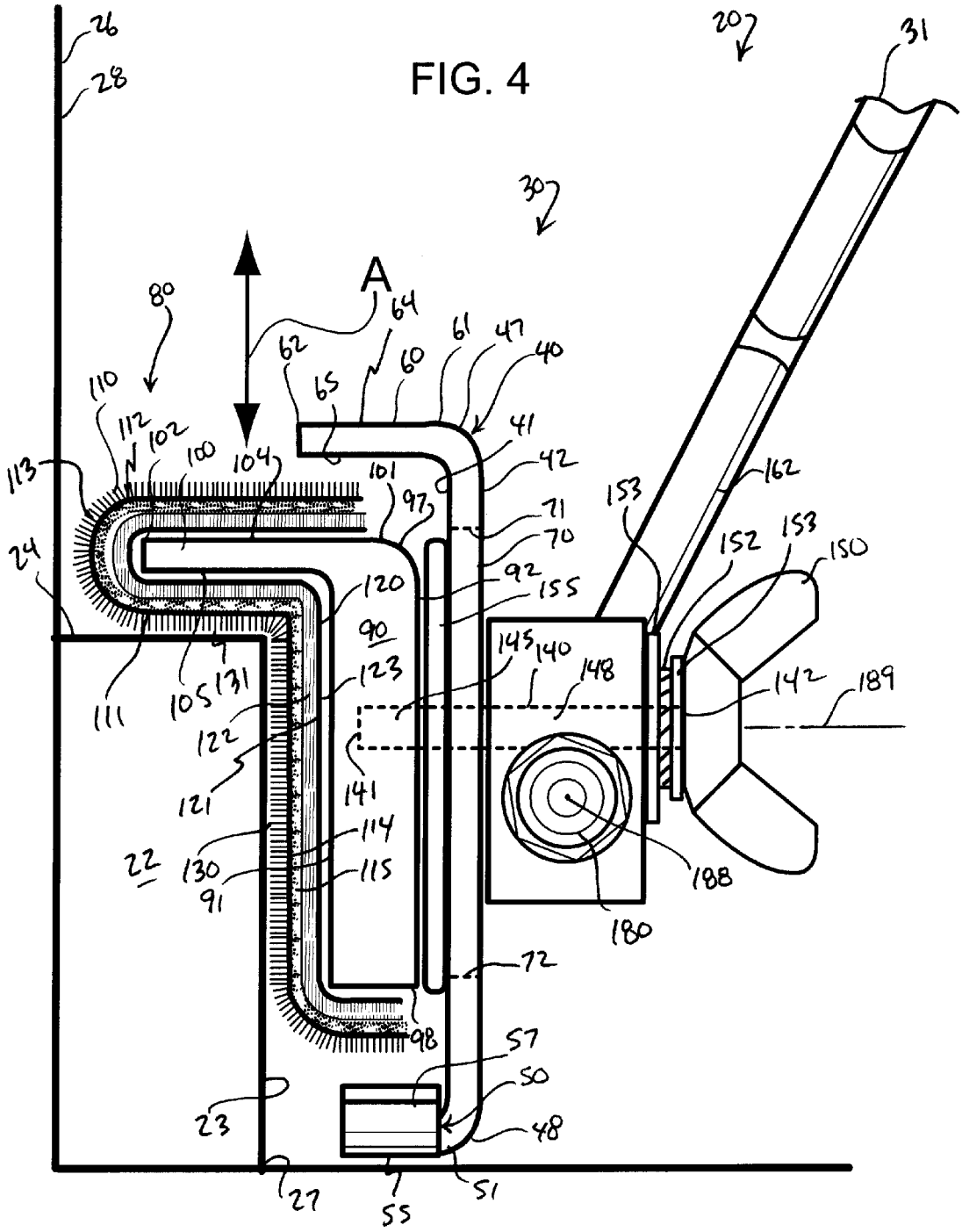
FIG. 4 is an enlarged side elevation view of the cleaning head assembly of the baseboard cleaning apparatus of FIG. 1 shown at it would appear in use cleaning a baseboard.
Figure 5:
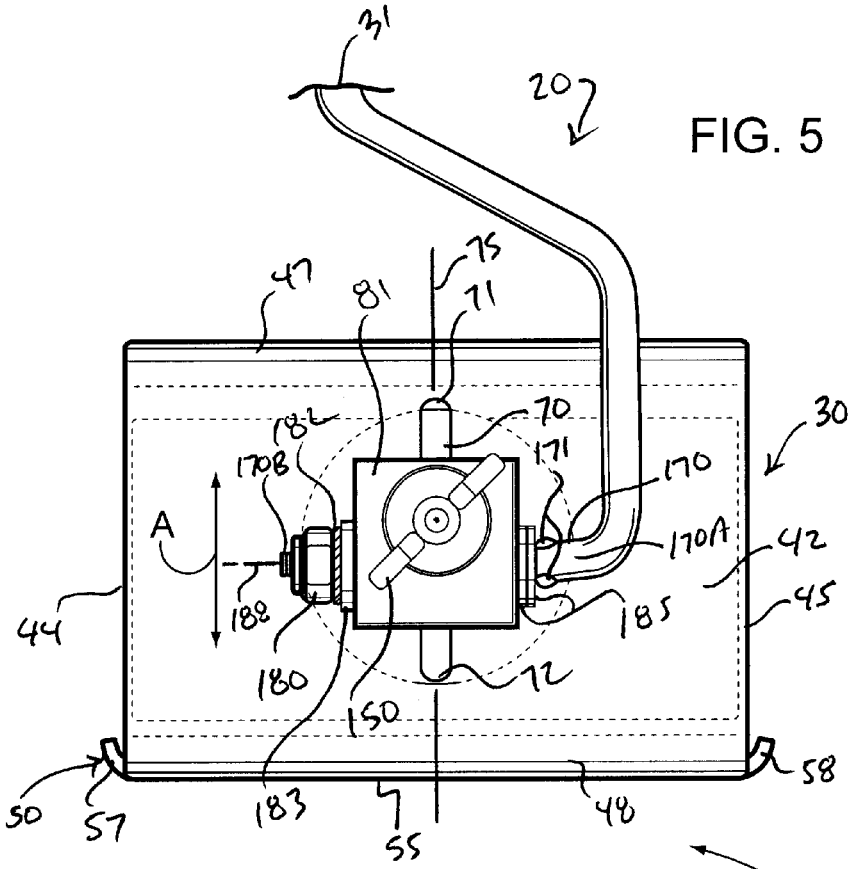
FIG. 5 is rear elevation view of the cleaning head assembly of the baseboard cleaning apparatus of FIG. 1.

Referring in relevant part to FIGS. 3 and 4, cleaning head assembly 30 includes a skid plate, which is denoted generally at 40, and which is fashioned of plastic, metal, wood, or other substantially rigid, resilient material or combination of materials. Skid plate 40 is preferably integrally formed, such as through molding or machining, but may, if desired, be fashioned of two or more attached parts fastened together with adhesive, welding, screws, nails, etc. Skid plate 40 has opposed planar, parallel inner and outer faces 41 and 42, opposed parallel sides 44 and 45, and opposed parallel upper and lower extremities 47 and 48 extending between sides 44 and 45. A skid 50 is formed in lower extremity 48 skid plate 40. Skid 50 is a long, slender runner that extends along the entire length of lower extremity 48 from side 44 to side 45, and is configured to slide along a floor adjacent to a baseboard to be cleaned. Skid 50 has an inner edge 51 affixed to lower extremity 48, and extends or otherwise projects horizontally outward with respect to inner face 41 of skid plate 40 to an opposed outer edge 52. Inner and outer edges 51 and 52 of skid 50 are substantially parallel with respect to each other. Skid 50 further includes an upper surface 54 directed upwardly toward inner face 41 of skid plate 40, an opposed, parallel lower surface 55, and opposed, upturned or upwardly curved portions or ends 57 and 58 formed proximate to sides 44 and 45 of skid plate 40. Upturned ends 57 and 58 are curve upwardly toward upper extremity 47 of skid plate 40, and project somewhat outboard of the respective sides 44 and 45 of skid plate 40, and this aspect is best illustrated in FIG. 5, which is a rear elevation view of cleaning head assembly 30.

With continuing reference in relevant part to FIGS. 3 and 4, a top wall 59 is formed in upper extremity 47. Top wall 59 is long and slender and extends along the entire length of upper extremity 47 from side 44 to side 45. Top wall 59 has an inner edge 61 affixed to upper extremity 47, and extends or otherwise projects horizontally outward with respect to inner face 41 of skid plate 40 to an opposed outer edge 62. Inner and outer edges 61 and 62 of top wall 59 are substantially parallel with respect to each other. Top wall 59 further includes an upper surface 64 and an opposed, parallel lower surface 65 directed downwardly toward inner face 41 of skid plate 40 and upper surface 54 of skid 50. Top plate 60 is substantially parallel with respect to skid 50, and top plate 60 and skid 50 are each substantially perpendicular with respect to inner face 41 of skid plate 50.

A slot 70 is formed in skid plate 40. Slot 70 is a long slender opening and is formed through skid plate from inner face 41 to outer face, extends substantially vertically upright between upper extremity 47 and lower extremity 48, and is further positioned between, and is substantially parallel with respect to, opposed sides 44 and 45. Slot 70 is located at a substantially intermediate position between sides 44 and 45, and between upper and lower extremities 47 and 48. Slot 70 extends substantially vertically upright between upper and lower extremities 47 and 48 along a plane 75 (FIG. 5) extending along slot 70 from upper end 71 of slot 70 and lower end 72 of slot 70, which plate 75 and slot 70 are is substantially perpendicular with respect to upper and lower extremities 47 and 48, in which case slot 70 has an upper end 71 directed toward upper extremity 47, and extends downwardly therefrom to an opposed lower end 72 directed toward lower extremity 48.

Cleaning head assembly 30 further includes a cleaning head denoted generally at 80 that is applied along inner face 41 of skid plate 40 between top wall 59 formed upper extremity 47 and skid 50 formed in lower extremity 48, and a fixture 81 that is applied along outer face 41 in opposition to cleaning head 80 between upper and lower extremities 47 and 48. Cleaning head 80 consists of a support member 90 that, like skid plate 40, is fashioned of plastic, metal, wood, or other substantially rigid, resilient material or combination of materials. Support member 90 is preferably integrally formed, such as through molding or machining, but may, if desired, be fashioned of two or more attached parts fastened together with adhesive, welding, screws, nails, etc.

Support member 90 has opposed planar, parallel inner and outer faces 91 and 92, opposed parallel sides 94 and 95, and opposed parallel upper and lower extremities 97 and 98 extending between sides 84 and 95. A top wall 99 is formed in upper extremity 97 of support member 90. Top wall 99 is broad and flat and extends along the entire length of upper extremity 97 of support member 90 from side 94 to side 95. Top wall 99 has an inner edge 101 affixed to upper extremity 97, and extends or otherwise projects horizontally outward with respect to inner face 91 of support member 90 to an opposed outer edge 102. Inner and outer edges 101 and 102 of top wall 99 are substantially parallel with respect to each other. Top wall 99 further includes an upper surface 104 and an opposed, parallel lower surface 105 directed downwardly toward inner face 91 of support member 90. Top plate 100 is substantially perpendicular with respect to inner face 91.

Cleaning head 80 is formed with, or otherwise supports, a pliant, flexible, cleaning pad denoted generally at 110. Cleaning pad 110 consists of a broad, flat, pliant substrate or backing 111 formed of woven or non-woven polyester, cotton, or other like or similar fabric or fabric-like material. Backing 111 has an outer surface 112 formed with an applied cleaning media 113, and an opposed inner surface 114 formed with an applied hook media 115. Cleaning media 113 is provided in the form of a large population of soft, pliant cleaning bristles. In other embodiments, cleaning media 113 can be a dry cloth, or perhaps a sponge useful in wet cleaning through the application of water or a liquid cleanser.

Another substrate or backing 120 is also provided, which is broad, flat, and pliant and, like backing 111, is formed of woven or non-woven polyester, cotton, or other like or similar fabric or fabric-like material. Backing 120 is substantially coextensive with respect to not only backing 111 of cleaning pad 110, but also to inner face 91, upper surface 104, and lower surface 105 of support member 90. Backing 120 has an outer surface 121 formed with an applied loop media 122, and an opposed adhesive inner surface 123. Adhesive inner surface 123 is applied concurrently to and across inner face 91, upper surface 104, and lower surface 105 of support member 90 covering such surfaces and adhesively securing substrate 120 in place to support member 90 so as to substantially and concurrently cover inner face 91, upper surface 104, and lower surface 105 of support member 90 with loop media 112, which is operatively exposed in preparation to receive the corresponding hook media 115 of cleaning pad 110. The pliant characteristic of backing 120 allows backing 120 to be manipulated as needed to apply adhesive inner surface 123 to and across inner face 91, upper surface 104, and lower surface 105 of support member 90 so as to substantially conform to such surfaces.

To apply cleaning pad 110 to support member 90 to cover inner face 91, upper surface 104, and lower surface 105 of support member 90 with cleaning media 113 in preparation for use in cleaning a baseboard, cleaning pad 110 is taken up and inner surface 114 supporting hook media 115 is directed toward loop media 122 carried by outer surface 121 of backing 120, and cleaning pad 110 is maneuvered and manipulated to apply hook media 115 against and across loop media 122 engaging hook media 115 to loop media 122 releasably securing cleaning pad 110 to support member 90 so as to substantially and concurrently cover loop media 122 applied across inner face 91, upper surface 104, and lower surface 105 of support member 90 thereby covering loop media 122 and also inner face 91, upper surface 104, and lower surface 105 of support member 90 with cleaning media 113, which is operatively exposed in preparation for use in cleaning a baseboard. The pliant characteristic of cleaning pad 110 allows cleaning pad 110 to be manipulated as needed to apply hook media 115 to and across loop media 112 applied to and across inner face 91, upper surface 104, and lower surface 105 of support member 90 so as to substantially conform to such surfaces to form in cleaning media 113 of cleaning pad 110 of cleaning head 80 opposed cleaning faces 130 and 131 configured by the orientation of inner face 91 and lower surface 105 of support member 90 to simultaneously contact adjoining front and top faces 23 and 24, respectively, of baseboard 22 denoted in FIG. 1. Face 130 extends upright along and across inner face 91 of support member 90, and is substantially perpendicular with respect to face 131 that extends along and across lower surface 105 of top wall 99, and which extends horizontally outward with respect to face 130.

Hook media 115 and the corresponding loop media 122 together form an engagement assembly to releasably secure cleaning pad 110 to cleaning head 80, in which hook and loop media 115 and 122 form a hook and loop fastener. The hook media 115 is an element of this engagement assembly, and loop media 122 is the corresponding complementing element of the engagement assembly. Although hook media 115 is carried by cleaning pad 110 and the corresponding loop media 122 is carried by cleaning head 80, this arrangement can be reversed if so desired without departing from the invention. The releasable attachment of between cleaning pad 110 and cleaning head 80 allows cleaning pad 110 to be removed for cleaning or replacement.

As previously mentioned, cleaning head 80 is applied along inner face 41 of skid plate 40 between top wall 59 formed upper extremity 47 and skid 50 formed in lower extremity 48, and fixture 81 that is applied along outer face 41 in opposition to cleaning head 80 between upper and lower extremities 47 and 48. A connector 140, which is elongate and formed of steel, plastic, or other strong, rigid material or combination of materials, extends through slot 70 and connects cleaning head 80 to fixture 81 capturing skid plate 40 between cleaning head 80 and fixture 81. Cleaning head 80 and fixture 81 are applied along inner and outer faces 41 and 42, respectively of skid plate 40 on across slot 70. Outer face 92 of support member 90 is directed toward inner face 41 of skid plate 40, upper extremity 97 of support member formed with top wall 99 is directed toward lower surface 65 of top wall 59 of skid plate 40 such that top wallj 99 extends away from or otherwise outwardly with respect to inner face 41 of skid plate and that upper surface 104 of top wall 100 confronts and opposes lower surface 65 of top wall 60 of skid plate 40, and lower extremity 98 of support member 90 is directed toward and opposes skid 50 formed in lower extremity 48 of skid plate 40. With cleaning head 80 so positioned with respect to skid plate 40, cleaning surface 130 of cleaning pad 110 applied along and across inner face 91 of support member 90 and cleaning surface 131 of cleaning pad 110 applied along and across lower surface 105 of top wall 100 are held and presented outwardly by cleaning head 80 with respect to skid plate 40 in preparation for use in cleaning a baseboard.

Connector 141 is applied through slot 70 and has an inner end 141 directed away from inner face 41 of skid plate 40 and at cleaning head 80 and which is secured to cleaning head 80, and an opposed outer end 142 directed away from outer face 42 of skid plate 40 and at fixture 81 and which is secured to, or otherwise with respect to, fixture 81. Inner end 141 is received by a blind bore 145 (FIG. 4) formed in support member 90 of cleaning head 80 through outer face 92, and is preferably press fit in blind bore 145 securing inner end 141 to support member 90. If desired, adhesive may be applied between inner end 141 and blind bore 145. In a further embodiment, inner end 141 may be threaded onto support member 90, or welded to support member 90.

Fixture 81 is block of plastic, metal, wood, or other substantially rigid, resilient material or combination of materials. Outer end 142 of connector 140 is threaded, extends into and through an opening or through hole 148 formed in fixture 81, and a wing nut 150 is threaded onto outer end 142 on the outer side of fixture 81, which is tightened by hand securing skid plate 40 and fixture 81 between support member 90 and wing nut 150 thereby clamping and securing skid plate 40 between cleaning head 80 and the inner side of fixture 81. In this embodiment as a matter of example, a lock washer 152 is positioned between opposed standard washers 153, which encircle outer end 142 of connector 140 and which are positioned between wing nut 150 and the outer side of fixture 81. Furthermore, a broad washer 155 also encircles connector 140 between inner and outer ends 141 and 142 and is positioned between inner face 41 of skid plate and outer face 92 of support member 90.

Handle 31 is attached to cleaning head assembly 30 and, as best seen in FIG. 1, is sufficiently long to permit a user to take up handle 31 and wield apparatus 20 by hand to clean a base board. Handle 31 is formed of plastic or metal or other substantially rigid material or combination of materials, and has a proximal end 160 formed with a handle 161, and an opposed distal end 162 secured to cleaning head assembly 30. Distal end 162 is attached to fixture 81 as seen in FIGS. 1, 2, and 4-9.

Figure 9:
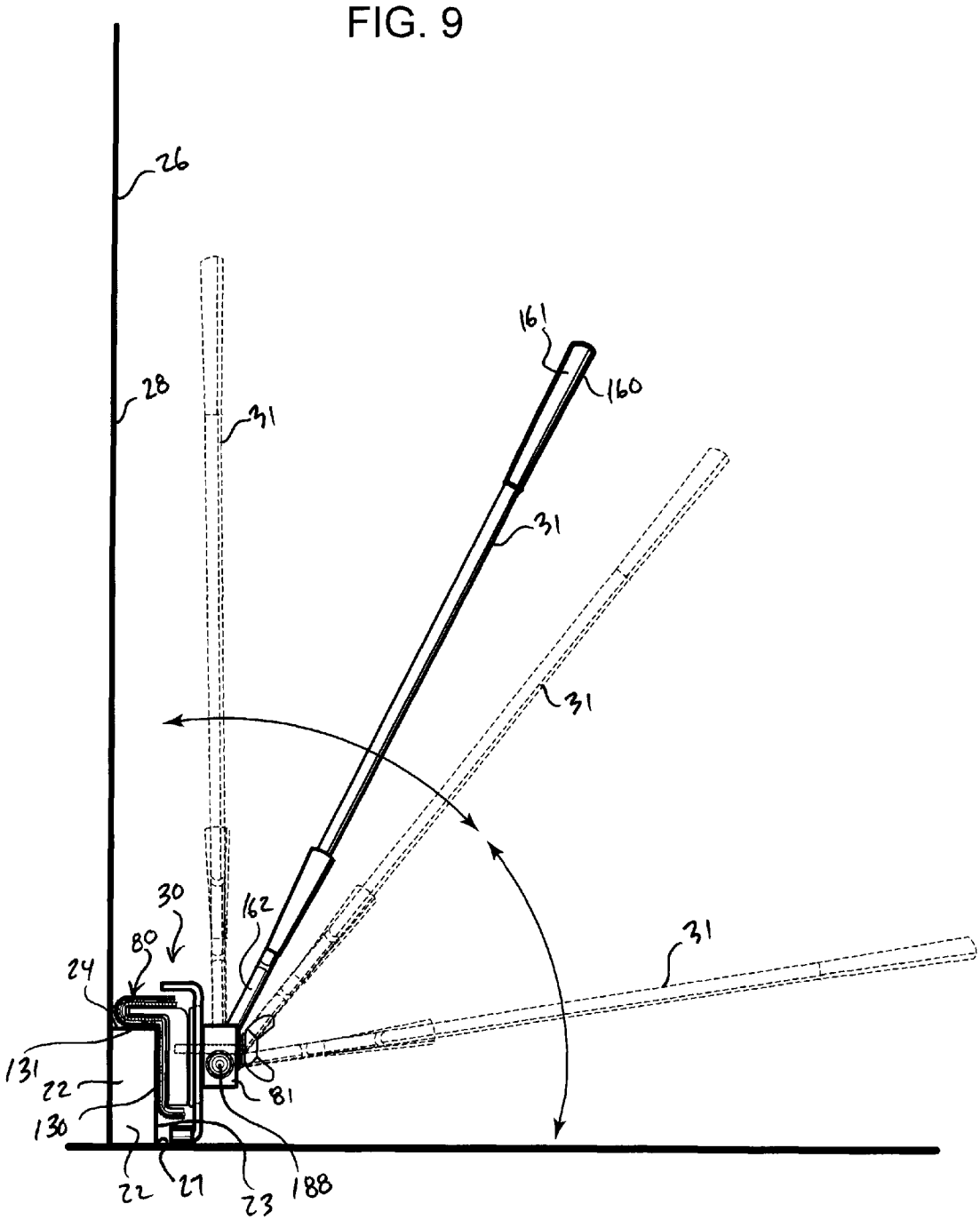
FIG. 9 is a side elevation view of the baseboard cleaning apparatus similar to that of FIG. 1 illustrating different positions of the handle attached to the cleaning head assembly of the baseboard cleaning apparatus.

Referencing FIG. 4, distal end 162 is formed with an inturned extension 170 having an inner end 170B formed with a stop 171, and an opposed outer end 170B, which is threaded. Outer end 170B extends into and through an opening or through hole 175 formed in fixture 81, which is transverse with respect to through hole 148 and parallel with respect to outer face 42 of skid plate 40, and is threaded onto a threaded nut 180. Threaded nut 180 is threaded onto outer end 170B alongside fixture 81, and is tightened securing fixture 81 between nut 180 and stop 171 formed at inner end 170A of extension 170 thereby securing distal end 162 of handle 31 to fixture 81 and, thus, to cleaning head assembly 31. In this embodiment as a matter of example with specific reference to FIGS. 3 and 5, a lock washer 182 and a standard washer 183 encircle outer end 170B of extension 170 and are positioned between nut 180 fixture 81. Also, a pair of standard washers 185 encircle inner end 170B of extension and are positioned between fixture 81 and stop 171, which, in this instance, is formed by opposed, outwardly projecting tabs formed in inner end 170B of extension. Extension 170 if free to pivot along an axis of rotation denoted at 188 (FIGS. 2-9) in through hole 175 of fixture 81 to allow handle 31 to pivot with respect to cleaning head assembly 30, which allows handle to pivotally raised and lowered with respect to cleaning head assembly 30 as needed during use of apparatus 20 in cleaning a baseboard. As a matter of example, FIG. 9 is a side elevation view of apparatus 20 similar to that of FIG. 1 illustrating different pivotal positions of handle 31 with respect to cleaning head assembly 30 as depicted in phantom outline. Extension 170 extends along and defines axis of rotation 188 of handle 31, which axis 188 is parallel with respect to outer face 42 of skid plate as substantially shown in FIG. 2.

Figure 2:
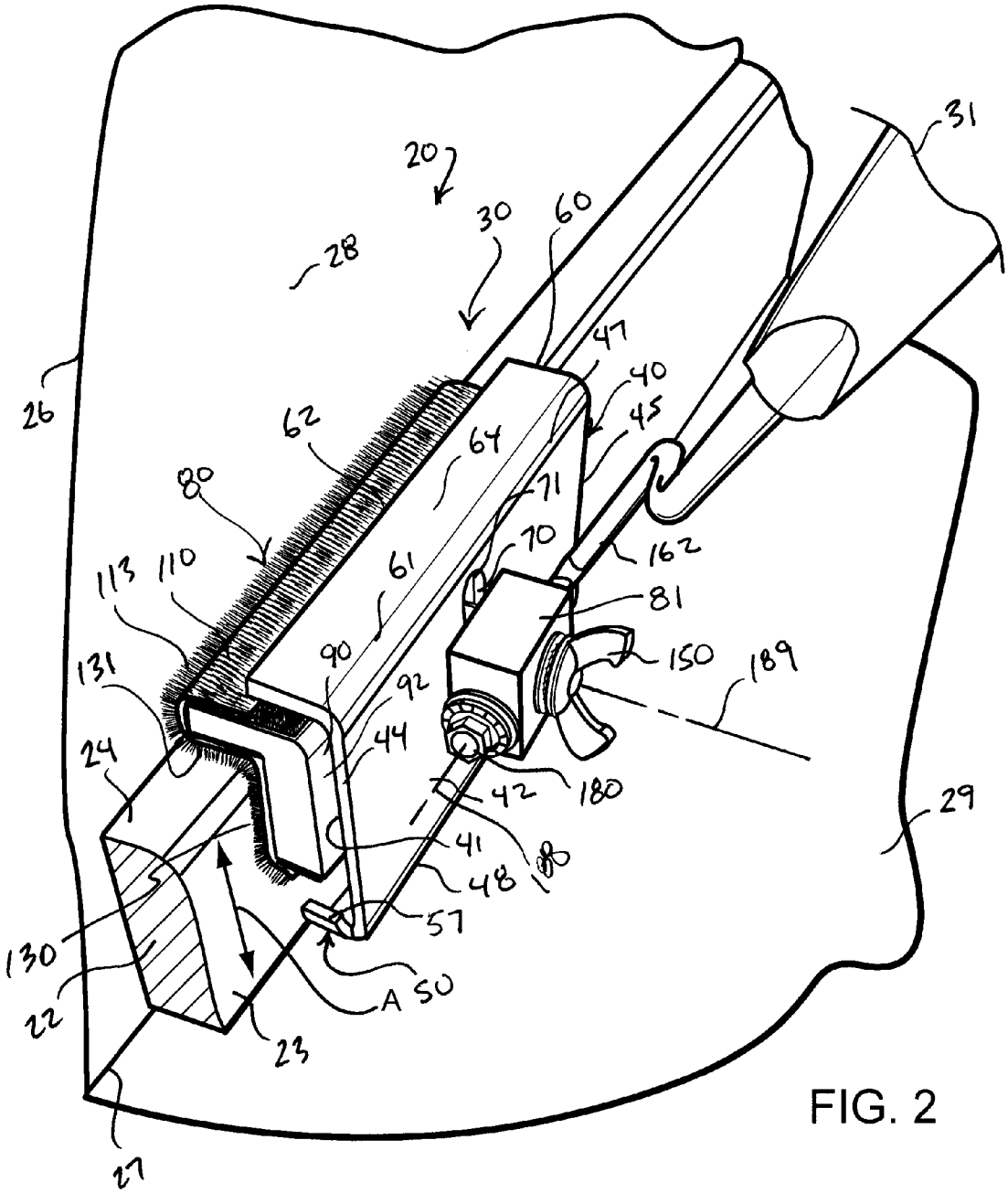
FIG. 2 is an enlarged perspective view of the cleaning head assembly of the baseboard cleaning apparatus of claim 1 shown as it would appear in use cleaning a baseboard.

In the use of apparatus 20 as seen in FIG. 1, handle 31 is taken up by hand and is used to apply cleaning head assembly 30 against baseboard 22 for cleaning purposes, which is also shown in FIGS. 2 and 4. To clean baseboard 22 as best seen in FIGS. 2 and 4, cleaning pad 110 is applied against baseboard 22 concurrently locating cleaning surfaces 130 and 131 of cleaning pad 110 of cleaning head 80 against front and top faces 23 and 24 of baseboard 22, and locating lower surface 55 of skid 50 against floor 29 opposite to baseboard 22. Cleaning head 80 is positioned with respect to skid plate 50 to permit cleaning surfaces 130 and 131 of cleaning pad 110 of cleaning head 80 to locate against front and top faces 23 and 24 of baseboard 22 concurrently with the application of lower surface 55 of skid 50 against floor 29. Cleaning surfaces 130 and 131 of cleaning pad 110 are configured to contact the adjoining front and top faces 23 and 24 of baseboard 22 to allow a user to clean front and top faces 23 and 24 simultaneously by moving cleaning head assembly 30 back and forth along baseboard 22 with the use of handle 31. Lower surface 55 of skid 50 glides along the surface of floor 29 opposite to baseboard 22 and provides reliable support for cleaning head assembly 30 as it is moved back and forth along baseboard 22. Upturned ends 57 and 58 formed in either end of skid 50 ensure skid 50 slides effortless across floor 29, and prevents skid plate 40 from unwanted snagging, such as on carpet material, rug material, or other like or similar material that could be applied to floor 29.

As mentioned above, cleaning head 80 is positioned with respect to skid plate 50 to permit cleaning surfaces 130 and 131 of cleaning pad 110 of cleaning head 80 to locate against front and top faces 23 and 24 of baseboard 22 concurrently with the application of lower surface 55 of skid 50 against floor 29. Cleaning head 80 is adjustable in reciprocal directions with respect to skid 50 as generally indicated by the double arrowed line A in FIGS. 4 and 5 between raised and lowered positions with respect to skid 50 to permit head 80 to be positioned relative to skid 50 to permit cleaning surfaces 130 and 131 of cleaning pad 110 of cleaning head 80 to locate against front and top faces 23 and 24 of baseboard 22 concurrently with the application of lower surface 55 of skid 50 against floor 29. This reciprocal adjustability of cleaning head 80 is provided by slot 70 and connector 140 applied through slot 70 interconnecting support member 90 of cleaning head 80 to fixture 81. In particular, connector 140 is movable along slot 70 between upper and lower ends 71 and 72 of slot 70 between lowered positions of cleaning head 80 and fixture 81 away from upper extremity 47 of skid plate toward skid 50 formed in lower extremity 48 of skid plate 40 as substantially shown in FIG. 7, and raised positions of baseboard cleaning head 80 and fixture 81 away from skid 50 formed in lower extremity 48 of skid plate 50 toward upper extremity 47 of skid plate 40 as substantially shown in FIG. 6. This reciprocal adjustment may be carried out simply by applying sufficient force, such as by hand, to cleaning head 80 and fixture 81 to concurrently slide cleaning head 80 and fixture 81 across skid plate 40 along groove 70 to thus move connector 140 upwardly and downwardly along groove 70 as needed to obtain the required position of cleaning head 80 with respect to skid 50. If desired, wing nut 150 may be loosened to assist a user in adjusting cleaning head 80 to a desired position before retightening wing nut 150 to secure cleaning head 80 at the desired position.

Figure 5A:
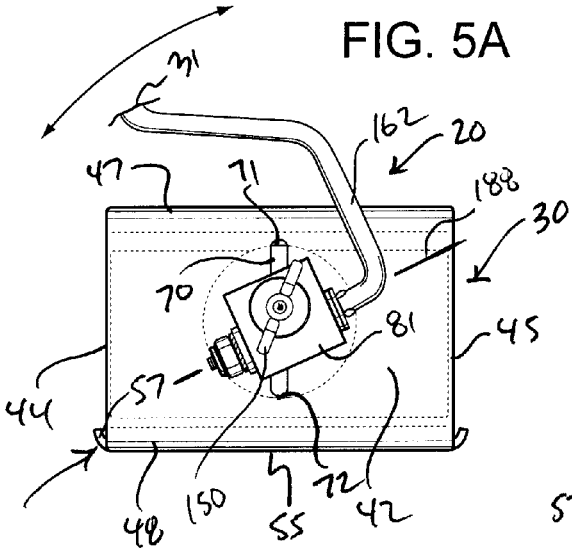
FIG. 5A is a view similar to that of FIG. 5 illustrating the handle as it would appear pitched at an angle with respect to the cleaning head assembly.
Figure 5B:
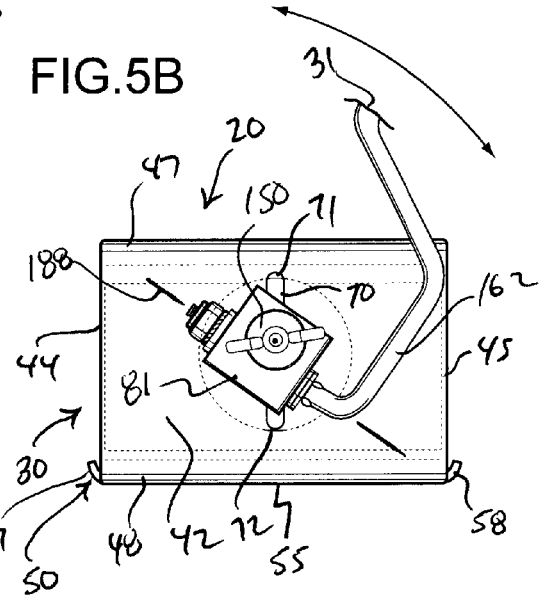
FIG. 5B is a view similar to that of FIG. 5A illustrating the handle as it would appear pitched at an another angle with respect to the cleaning head assembly.

Use of apparatus 20 may be improved by angling handle 31 with respect to cleaning head assembly 30. Connector 140 resides along an axis of rotation 189 denoted in FIGS. 2-9, which extends through connector 140 from inner end 141 referenced in FIG. 4 to outer end 142 referenced best in FIG. 3. Fixture 81 is able to rotate about axis of rotation 189 with respect to connector 140 through the application of a force applied to handle 31 to permit distal end 162 of handle 31 and fixture 81 to be rotated about axis of rotation 189 to the left as seen in FIG. 5A toward side 44 of skid plate 40 to pitch handle 31 at a desired or selected leftward angle with respect to cleaning head assembly 30, and to be rotated about axis of rotation 189 to the right as seen in FIG. 5B toward side 45 of skid plate 40 to pitch handle 31 at a desired or selected rightward angle with respect to cleaning head assembly 30. If desired, wing nut 150 may be loosened and fixture 81 and handle 31 rotated about axis of rotation 189 to a desired orientation and then wing nut 150 may be tightened to secure handle 31 and fixture 80 at the selected orientation. Axis of rotation 189 is substantially perpendicular with respect to outer face 42 of skid plate 40.

Figure 7:
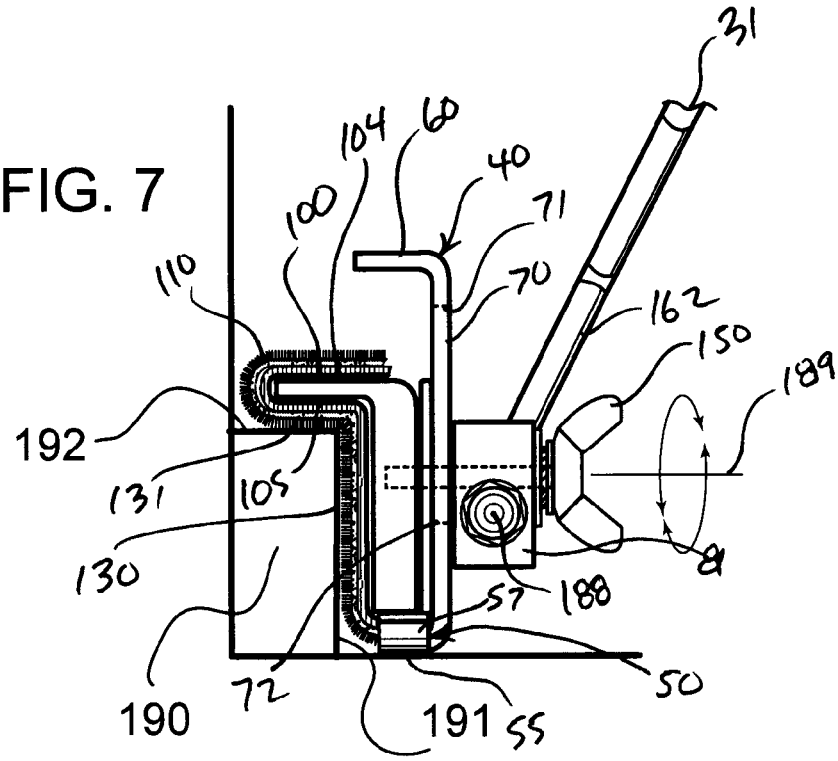
Figure 8:
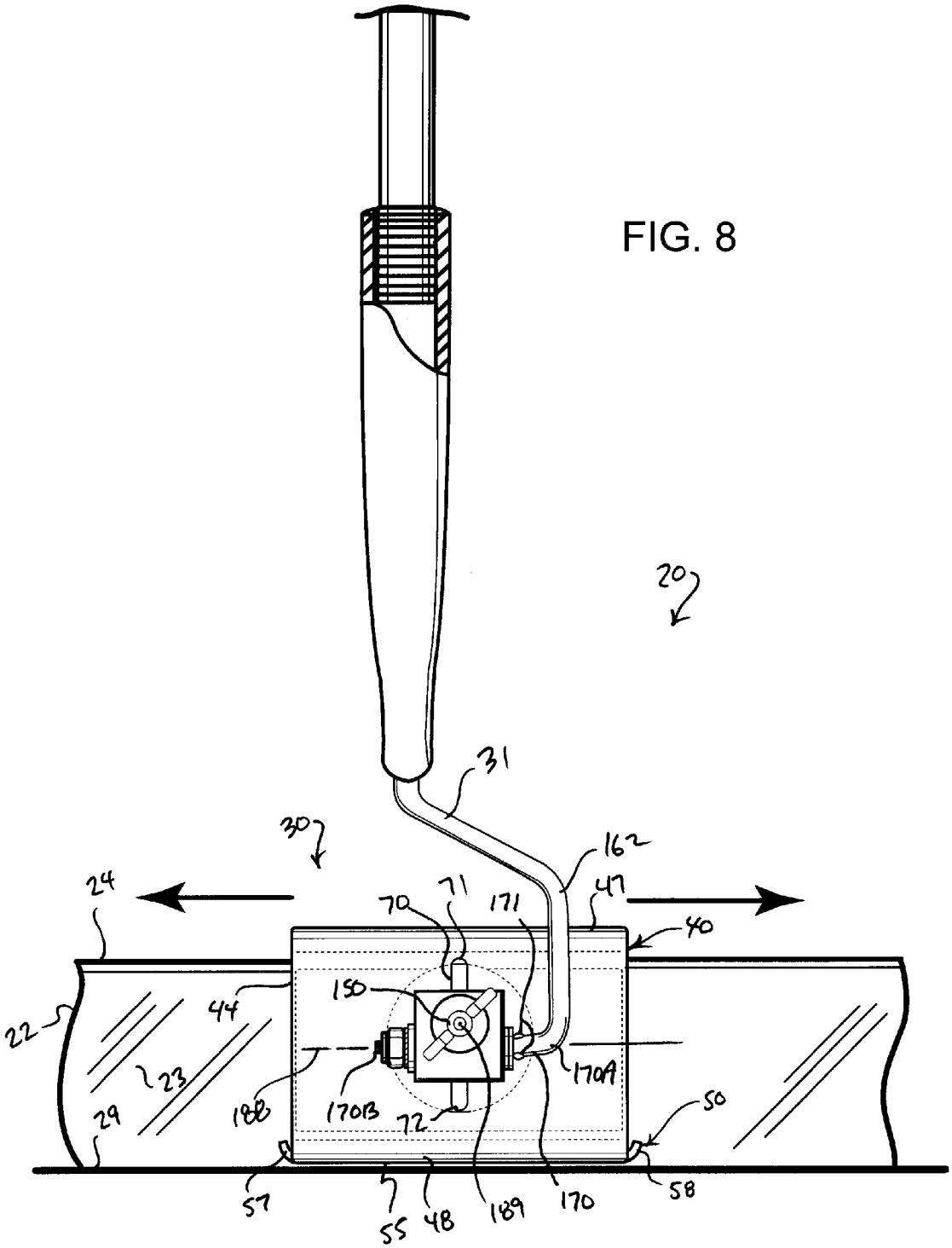
FIG. 8 is a rear elevation view of a cleaning head assembly of the baseboard cleaning apparatus of FIG. 1 shown as it would appear positioned upon a floor adjacent to a baseboard to be cleaned.

As matter of illustration and reference, FIG. 7 illustrates baseboard 190 having adjoining front and top faces 191 and 192. Baseboard 190 is applied to wall surface 28, and is conventionally nailed, screwed, or glued to wall 26. Baseboard 190 and wall 26 extend upright with respect to floor 29, which is substantially horizontal with respect to baseboard 190 and wall 26. Baseboard 190 forms part of wall 26, and extends upright along wall surface 28 with respect to floor 29. Baseboard 190 is a low profile or short baseboard as shown in FIG. 7, and cleaning head 80 is adjusted into a lowered position with respect to skid 50 as discussed above to permit head 80 to be positioned relative to skid 50 to permit cleaning surfaces 130 and 131 of cleaning pad 110 of cleaning head 80 to locate against front and top faces 191 and 192 of baseboard 190 concurrently with the application of lower surface 55 of skid 50 against floor 29.

Figure 6:
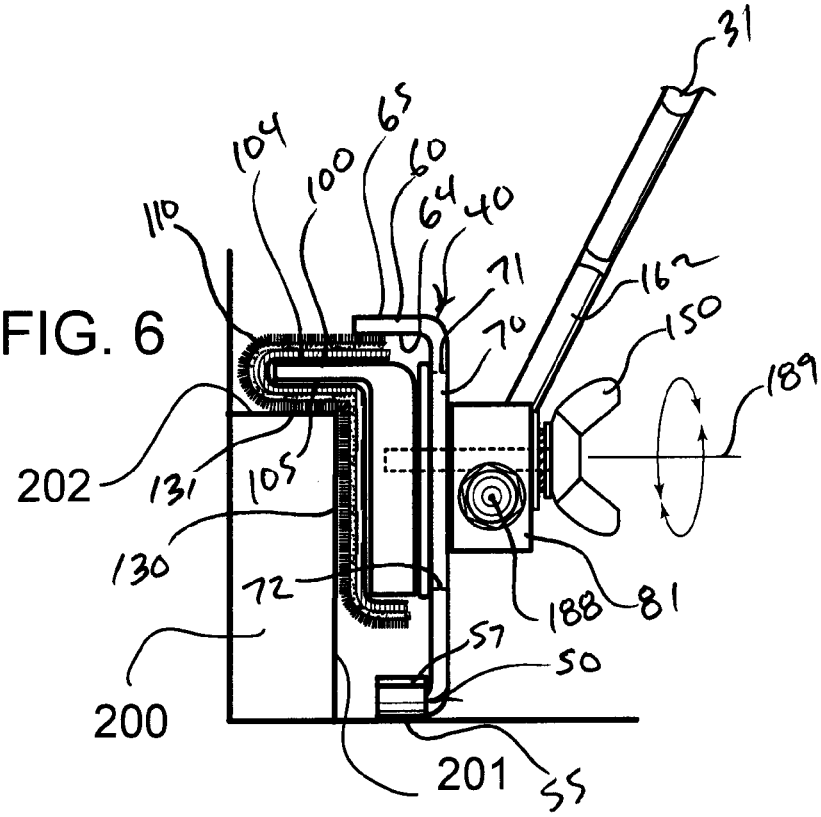
FIGS. 6 and 7 are side elevation views of the cleaning head assembly of the baseboard cleaning apparatus of FIG. 1 shown as it would appear in use cleaning baseboards of varying size.

FIG. 6 illustrates baseboard 200 having adjoining front and top faces 201 and 202. Baseboard 200 is applied to wall surface 28, and is conventionally nailed, screwed, or glued to wall 26. Baseboard 200 and wall 26 extend upright with respect to floor 29, which is substantially horizontal with respect to baseboard 200 and wall 26. Baseboard 200 forms part of wall 26, and extends upright along wall surface 28 with respect to floor 29. Baseboard 200 is high profile or tall baseboard as shown in FIG. 6, and cleaning head 80 is adjusted into a raised position with respect to skid 50 as discussed above to permit head 80 to be positioned relative to skid 50 to permit cleaning surfaces 130 and 131 of cleaning pad 110 of cleaning head 80 to locate against front and top faces 201 and 202 of baseboard 200 concurrently with the application of lower surface 55 of skid 50 against floor 29. Baseboard 22 referenced in FIGS. 1 and 4 has a height that lower than baseboard 200 in FIG. 6 and higher than baseboard 190 shown in FIG. 7, and cleaning head 80 is, accordingly, adjusted and positioned at an intermediate position with respect to the upper and lower positions of cleaning head 80 as demonstrated in FIGS. 6 and 7 to permit the concurrent application of cleaning surfaces 130 and 131 to baseboard 20 and skid 50 to floor 29.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A baseboard cleaning apparatus for cleaning a baseboard of a wall extending upright along the wall with respect to a floor, the baseboard having a front face and a top face, the baseboard cleaning apparatus comprising:

a skid plate having opposed inner and outer faces, opposed first and second sides, opposed upper and lower extremities extending between the opposed first and second sides, and a skid formed in the lower extremity of the skid plate extending from the first side of the skid plate to the second side of the skid plate and which is configured to slide along the floor adjacent to the baseboard;

a slot, having opposed upper and lower ends, formed through the skid plate between the opposed first and second sides of the skid plate and which extends from the lower end directed toward the lower extremity of the skid plate to the upper end directed toward the upper extremity of the skid plate;

a baseboard cleaning head positioned along the inner face of the skid plate between the upper extremity of the skid plate and the skid formed in the lower extremity of the skid plate, the baseboard cleaning head having first and second cleaning faces configured to simultaneously contact the front and top faces of the baseboard;

a fixture positioned along the outer face of the skid plate between the upper extremity of the skid plate and the skid formed in the lower extremity of the skid plate;

a connector extending through the slot connecting the cleaning head to the fixture capturing the skid plate between the cleaning head and the fixture; and the connector movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

2. The baseboard cleaning apparatus according to claim 1, further comprising a washer encircling the connector and positioned between the baseboard cleaning head and the inner face of the skid plate.

3. The baseboard cleaning apparatus according to claim 1, further comprising a handle mounted to the fixture.

4. The baseboard cleaning apparatus according to claim 3, wherein the handle is further mounted to the fixture for pivotal movement.

5. The baseboard cleaning apparatus according to claim 1, wherein the skid comprises an elongate, flat runner having a first upturned portion formed proximate to the first side of the skid plate, and an opposed second upturned portion formed proximate to the second side of the skid plate.

6. A baseboard cleaning apparatus for cleaning a baseboard of a wall extending upright along the wall with respect to a floor, the baseboard having a front face and a top face, the baseboard cleaning apparatus comprising:

a skid plate having opposed inner and outer faces, opposed first and second sides, opposed upper and lower extremities extending between the opposed first and second sides, and a skid formed in the lower extremity of the skid plate extending from the first side of the skid plate to the second side of the skid plate and which is configured to slide along the floor adjacent to the baseboard;

a slot, having opposed upper and lower ends, formed through the skid plate between the opposed first and second sides of the skid plate and which extends from the lower end directed toward the lower extremity of the skid plate to the upper end directed toward the upper extremity of the skid plate;

a baseboard cleaning head positioned along the inner face of the skid plate between the upper extremity of the skid plate and the skid formed in the lower extremity of the skid plate, the baseboard cleaning head formed with a cleaning pad having first and second cleaning faces configured to simultaneously contact the front and top faces of the baseboard;

an engagement assembly releasably securing the cleaning pad to the baseboard cleaning head;

a fixture positioned along the outer face of the skid plate between the upper extremity of the skid plate and the skid formed in the lower extremity of the skid plate;

a connector extending through the slot connecting the cleaning head to the fixture capturing the skid plate between the cleaning head and the fixture; and the connector movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

7. The baseboard cleaning apparatus according to claim 6, wherein the engagement assembly comprises a hook and loop fastener having an element thereof carried by the cleaning pad and a complementing element thereof carried by the baseboard cleaning head.

8. The baseboard cleaning apparatus according to claim 6, further comprising a handle mounted to the fixture.

9. The baseboard cleaning apparatus according to claim 8, wherein the handle is further mounted to the fixture for pivotal movement.

10. The baseboard cleaning apparatus according to claim 6, further comprising a washer encircling the connector and positioned between the baseboard cleaning head and the inner face of the skid plate.

11. The baseboard cleaning apparatus according to claim 6, wherein the skid comprises an elongate, flat runner having a first upturned portion formed proximate to the first side of the skid plate, and an opposed second upturned portion formed proximate to the second side of the skid plate.

* * * * *